United States Patent [19]

Bouguyon et al.

[11] 3,991,836

[45] Nov. 16, 1976

[54] WELL BORE PERFORATING APPARATUS

[75] Inventors: Gérard Bouguyon, Plaisir; Pierre Chesnel, Savigny-sur-Orge, both of France

[73] Assignee: Schlumberger Technology Corporation, New York, N.Y.

[22] Filed: Sept. 8, 1975

[21] Appl. No.: 610,960

[30] Foreign Application Priority Data

Sept. 20, 1974 France ..... 74.31759

[52] U.S. Cl. ..... 175/4.6; 102/20; 102/24 HC

[51] Int. Cl.[2] ..... E21B 43/117

[58] Field of Search ..... 175/4.6; 102/20, 24 HC

[56] References Cited

UNITED STATES PATENTS

| | | | |
|---|---|---|---|
| 2,680,406 | 6/1954 | Austin | 102/20 |
| 2,756,677 | 7/1956 | McCullough | 102/20 |
| 2,980,017 | 4/1961 | Castel | 175/4.6 |
| 3,048,101 | 8/1962 | Lebourg | 175/4.6 |
| 3,143,068 | 8/1964 | Bell | 102/20 |
| 3,235,005 | 2/1966 | Delacour | 166/299 |
| 3,282,213 | 11/1966 | Bell et al. | 102/20 |
| 3,282,354 | 11/1966 | Hakala et al. | 175/4.6 |
| 3,327,630 | 6/1967 | Bell | 102/24 HC |
| 3,636,875 | 1/1972 | Dodson | 102/20 |

*Primary Examiner*—Stephen J. Novosad
*Attorney, Agent, or Firm*—Ernest R. Archambeau, Jr.; William R. Sherman; Stewart F. Moore

[57] ABSTRACT

In the representative embodiment of the present invention disclosed herein, this new and improved perforating apparatus includes a plurality of encapsulated shaped explosive charges having their forward ends respectively fitted and threadedly secured in a facing relationship along the concave rear face of an elongated steel carrier strip of a unique design having its forward face complementally shaped for accommodation within a given size of well bore piping thereby allowing the largest possible mass of explosive to be disposed in each capsule. To assure the proper installation of the detonating cord, the rear portions of the two-part charge capsules are cooperatively arranged in a unique fashion so as to be rotatably positionable in relation to their forward portions for facilitating proper alignment of transversely-oriented cord-receiving openings provided in the base of each capsule.

4 Claims, 4 Drawing Figures

FIG. 1
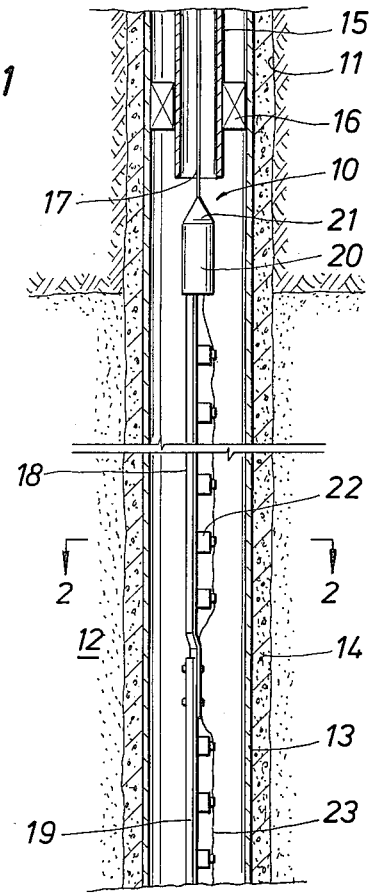
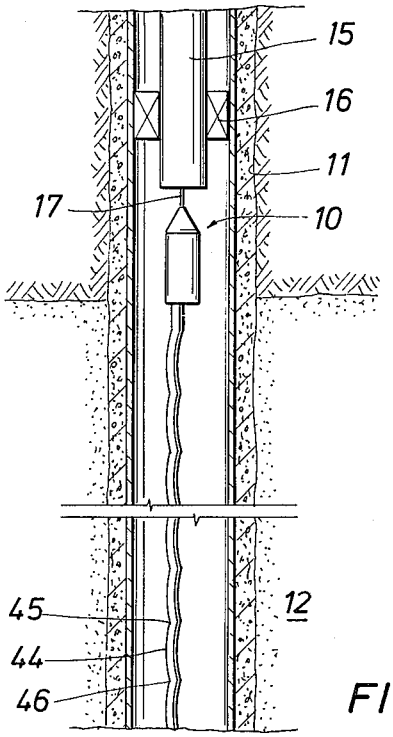
FIG. 4
FIG. 2
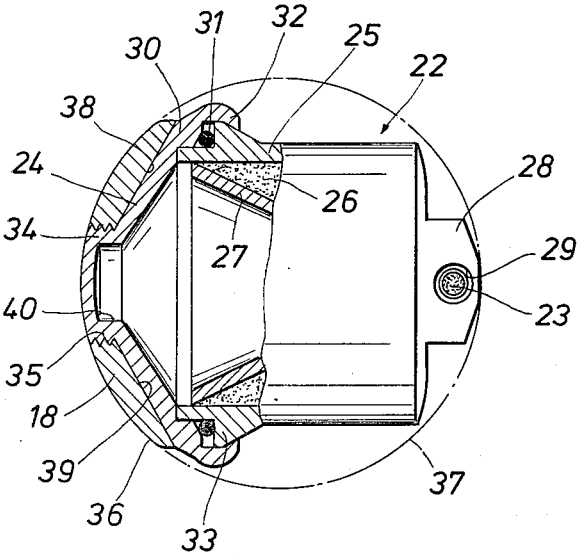
FIG. 3
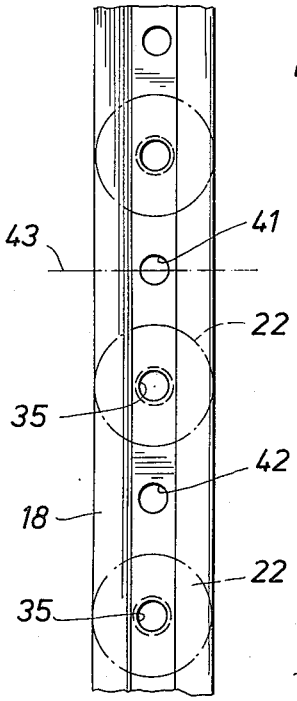

WELL BORE PERFORATING APPARATUS

Those skilled in the art will, of course, appreciate that heretofore many different kinds of expendable perforators using encapsulated shaped explosive charges mounted along a recoverable strip or wire carrier have been employed for through-tubing perforating operations. However, in recent years there has been a substantial decline in the usage of such perforators in at least the United States although they allow the largest-possible charges to be used in a well of a given size. Generally, this loss of popularity is attributed to such factors as the undesirable amounts of metal fragments or debris which these prior-art perforators ordinarily left in a well bore.

Experience has shown also that many prior-art capsule carriers otherwise suited for service in liquid-containing well bores are commonly broken or, as a minimum, severely damaged when operated in gas-filled wells. Thus, except where specially-designed carriers or devices such as these described in U.S. Pat. No. 3,282,213 and U.S. Pat. No. 3,636,875 are used, a strip or wire carrier which supports the charges by their sides may ordinarily be expected to break when the perforator is shot in a gas-filled well bore. It should also be realized that a significant amount of lateral clearance is required to support a capsule by its sides. Thus, even in such well-designed mounting arrangements, there is a corresponding decrease in the amount of explosive which can be provided for a given size of shaped charge thereby directly reducing the performance of that shaped charge.

As described in U.S. Pat. No. 3,177,808, in one prior-art arrangement which possibly avoids some of the above-discussed problems, the charge capsules are provided with threaded axial projections which are respectively extended through an enlarged hole in a flat metal strip and secured by a threaded nut on the opposite side of the fairly-short strip. An alternative proposal of similar nature publicized several years ago was to instead provide threaded charge-mounting holes in the carrier strip and thereby eliminate such retaining nuts. In this alternative front-mounting design, the carriers had moderately-curved forward faces and flat rear faces supposedly to strengthen them. The charges were screwed into the carrier and, in some manner, angularly positioned as required to install a length of detonating cord from charge to charge.

Nevertheless, experience has shown that carrier strips such as either of those just described are still not necessarily suited for safe or economical operation in gas-filled wells. For example, if the charges are too powerful for a particular strip, the carrier strip still may be readily severed. On the other hand, if it is of substantial length, even the sturdiest of such carrier strips may be bent in an exaggerated curve of such extent that the expended carrier may often become stuck in a small-diameter tubing string as the tool is being retrieved. It should also be recognized that elongated carrier strips with unsymmetrical transverse cross-sectional shapes are even more prone to being extensively deformed along their longitudinal axis.

Consideration must also be given toward providing some convenient arrangement for reliably retaining the detonating cord on perforators of this type. Moreover, the better practice is to position the cord in a generally-straight line so as to best accommodate shortening and contraction of the cord under extreme well bore pressures. Where the charges are secured on the strip carrier by a nut, it is, of course, quite simple to angularly orient the capsules to align their respective cord-retaining openings and then hold each charge in that position as its retaining nut is tightened. Alternatively, with threaded openings in the support member it has been necessary heretofore either to time or start the threads in each opening at a selected common angular orientation or else to simply orient the charges as they are installed regardless of whether they are tightened or not. Those skilled in the art will appreciate, however, that neither of those last-mentioned prior-art arrangements are satisfactory since the first requires painstaking care and needless expense in manufacturing the carriers and the second depends upon the detonating cord to retain most, if not all, of the charges in position.

As an additional consideration, those skilled in the art will also recognize the critical effects which even small dimensional changes may have upon the performance of any particular front-mounted shaped charge. This influence is, of course, even more pronounced with smaller charges inasmuch as even a small fraction of an inch can well represent a major percentage of change in some critical dimension. Thus, where a capsule-type perforator is to be sized for passage through one of the smaller sizes of well tubing, it must be appreciated that even a minor increase in the thickness of a carrier strip required to strengthen it for operation in gas-filled wells will correspondingly reduce the performance of the charges to be used with it.

As a summary of the present status of the prior art, therefore, it will be recognized that if the charge capsules are secured to the carrier by a nut on the opposite side, the thickness of these retaining nuts will represent a significant axial dimension which will be unavailable for enhancing the performance of the charges. On the other hand, those prior-art arrangements using threaded charge-mounting holes have required that many, if not all, of the capsules on a given strip remain loose. This latter arrangement is not altogether favored since the charges are positively retained in position on the carrier only so long as the detonating cord is intact. Therefore, if there is a misfire and the detonating cord is no longer intact, the charge capsules can easily be further unscrewed from the carrier and either fall into the well bore or else become sufficiently loosened to prevent recovery of the tool through a small-diameter tubing string. In any event, this latter prior-art arrangement make no provisions for positively retaining any remainder of the front caps of the expended charge capsules that may be left on the carrier strip.

Accordingly, it is an object of the present invention to provide new and improved perforating apparatus including encapsulated shaped charges which are cooperatively arranged and sized to achieve maximum performance but also are especially adapted to be tightly secured on a carrier strip but without unduly hampering the efficient installation of the detonating cord for the perforating apparatus.

This and other objects of the present invention are attained by new and improved expendable perforating apparatus carrying encapsulated shaped charges and including an elongated recoverable carrier strip having spatially-disposed threaded openings for cooperatively receiving threaded axial projections respectively arranged on the cover of each charge capsule. To facilitate the assembly of the perforating apparatus, each charge capsule is cooperatively arranged as two interfitted hollow parts which are fluidly sealed together but are uniquely left free to be turned relative to one another. In this manner, the front elements of the charge capsules can be securely mounted on the carrier strip and the rear elements can be turned as required to align the openings on the rear of the capsules which are arranged to retain the detonating cord.

The novel features of the present invention are set forth with particularity in the appended claims. The invention, together with further objects and advantages thereof, may be best understood by way of the following description of exemplary apparatus employing the principles of the invention as illustrated in the accompanying drawings, in which:

FIG. 1 shows a preferred embodiment of new and improved perforating apparatus arranged in accordance with the principles of the present invention as it will appear when positioned for operation in a typical gas-producing well;

FIG. 2 is an enlarged cross-sectional view of the perforating apparatus depicted in FIG. 1 and taken along the lines 2—2 thereof and particularly illustrates the unique construction of the charges used therewith;

FIG. 3 is an enlarged front view of a portion of the new and improved perforating apparatus depicted in FIG. 1; and FIG. 4 is a view similar to that shown in FIG. 1 but illustrates the new and improved perforating apparatus of the present invention after it has been operated.

Turning now to FIG. 1, a preferred embodiment of new and improved perforating apparatus 10 incorporating the principles of the present invention is depicted as it will appear when positioned in a typical well bore 11 penetrating one or more productive earth formations as at 12. As is common, a string of well casing 13 is cemented, as at 14, in the well bore 11 and a smaller-diameter piping string 15 carrying a typical production packer 16 is arranged for communicating the isolated interval therebelow with appropriate wellhead equipment (not shown) at the surface.

As illustrated, the new and improved perforating apparatus 10 is suspended in the well bore 11 by means of an armored electrical cable 17 which is spooled onto a powered winch (not shown) and electrically connected to a suitable power supply (not shown) adapted for providing sufficient electrical power to the perforator. The perforating apparatus 10 includes one or more elongated carrier strips, as at 18 and 19, which are tandemly intercoupled in a convenient manner and suspended below a typical collar locator 20 and a suitable cable head 21. The new and improved perforating apparatus 10 further includes a plurality of encapsulated shaped charges of a unique design as at 22 (which will subsequently be described in greater detail) that are respectively faced in the same direction and each mounted at closely-spaced intervals along the rear of the carrier strips 18 and 19. To provide for selective detonation of the several charges, as at 22, a length of typical detonating cord 23 is extended the full length of the perforating apparatus 10 and cooperatively retained on the rear of each charge capsule. The lower end of the detonating cord 23 is terminated at an electrically-responsive detonator (not shown) which is electrically connected to the suspension cable 17 in the usual fashion.

Turning now to FIG. 2, an enlarged, transverse cross-sectional view taken along the lines 2—2 in FIG. 1 is shown of the new and improved perforating apparatus 10 of the present invention for better illustrating the carrier strips, as at 18 and 19, as well as to show a preferred arrangement of the unique encapsulated charges 22 which significantly facilitates the installation of the detonating cord 23. As seen there, the encapsulated shaped charges 22 respectively include a hollowed steel case having a domed forward cover 24 and a forwardly-opening hollow container 25 which together cooperate to hold a typical shaped explosive pellet 26 carrying a conical metallic liner 27. The particular steel employed and various thicknesses used for a given design of the cases of the charges 22 will, of course, be in keeping with whatever design operating pressure is selected. As is typical, the base of the container 25 is provided with an enlarged boss 28 having a transverse opening 29 arranged therein for receiving the detonating cord 23 and positioning it as required for reliably detonating the charge 22. In the preferred embodiment of the unique charges 22, each has its domed cover 24 circumferentially enlarged, as at 30, and complementally shaped for receiving the forward, open portion of its container 25 and carrying a sealing member, such as an O-ring 31, in sealing engagement between opposing surfaces of the two case members.

During the manufacture of each unique shaped charge 22, its cover 24 is shaped for being crimped to form a peripheral lip 32 extending over and turning inwardly over the rear surface of an outwardly-enlarged shoulder 33 defined around its container 25. However, in sharp contrast to the usual practice of heretofore tightly or solidly crimping two case members together (such as shown, for example, in FIG. 8 of U.S. Pat. No. 3,235,005), the lip 32 is instead only snugly or firmly crimped in position over the container shoulder 33 so that a moderate twisting force will be sufficient for turning the container 25 angularly in relation to its cover 24. The significance of this unique arrangement will be subsequently explained.

Each of the encapsulated charges 22 is provided with an externally-threaded axial projection, as at 34, which extends forwardly from the charge cover 24 and is cooperatively arranged for threaded reception within a selected one of a plurality of tapped charge-mounting charge-mkounting openings, as at 35, which are centrally located and closely spaced along the length of the carrier strips as at 18. As depicted in FIG. 2, the closed forward ends of these axial projections 34 are respectively arranged to be substantially flush with the forward faces, as at 36, of the carrier strips as at 18. The forward faces 36 of the strips 18 and 19 are rounded or complementally shaped as required for passage through a given minimum size of typical well tubing. Similarly, the rear of the boss 29 is appropriately shaped so as to not project outside of an imaginary circle of a selected diameter, as at 37, as may be defined by the arcuately-shaped forward faces 36 of the carrier strips as at 18. This preferred arrangement will, therefore, enable the perforating apparatus 10 to be passed through any piping string, as at 15, having an internal bore which is at least slightly larger than the imaginary circle 37.

It will also be noted from FIG. 2, that the carrier strips, as at 18, are at least approximately of a uniform thickness thereby defining a rearwardly-opening concavity preferably with generally-flat, outwardly-diverging rearward faces, as at 38 and 39, along the full length of the strips. Thus, as depicted, the forward faces of the domed capsule covers, as at 24, are each complementally shaped to fit at least a major portion of the adjacent rearward faces 38 and 39 of the carrier strips, as at 18. In the preferred embodiment of the new and improved perforating apparatus 10, it has been found beneficial to form these rearward faces 38 and 39 to diverge at an angle slightly less than the complemental angle defined by the mating forward surfaces of the capsule covers 24 so as to better insure a tight or locking fit between their respective co-engaged surfaces once the charges 22 are mounted on the carrier strips as at 18.

Those skilled in the art will, of course, understand the importance of providing a maximum unimpeded clearance or so-called stand-off ahead of a shaped charge. In general, the penetrating capability of a given shaped charge will increase in direct relation to the axial distance that a perforating jet can travel as it is being formed before meeting an obstruction. Thus, in sharp contrast to those prior-art carriers previously described as having flat rearward faces, with all else being equal it will be appreciated that the crescent-like transverse cross-section of the new and improved carrier strips 18 and 19 of the present invention will provide a substantial and very significant increase in the available stand-off distance for the encapsulated charges as at 22.

It should also be realized that by hollowing the axial projections, as at 40, the available stand-off distance is even further increased by a significant amount almost equal to the length of the threaded projections 34. Another significant factor to be noted is that the concavity defined by the rearward faces, as at 38 and 39, of the carrier strips 18 and 19 will allow the interior of the charge covers 24 to be cooperatively shaped so as to position the rearward entrances of the internal bores 40 slightly ahead of the forwardly-directed, inwardly-convergent paths which will be followed by those liner particles forming the rear portions of the perforating jets produced upon detonation of the charges 22. Those skilled in the art will, therefore, appreciate that significant and often major increases in penetration for given charge designs are achieved by significantly increasing the available stand-off distance, by insuring that there will be little or no unwanted interference with the formation of their resulting jets, and also by allowing a maximum amount of the explosive 26 to be used in a given one of the charges 22.

As previously discussed, however, the severe and quite-substantial explosive forces which will be developed when an encapsulated shaped charge, as at 22, is detonated in a gas-filled well, as at 11, are ordinarily sufficient to at least seriously deform, if not altogether break, the various carrier strips of the prior art. In a preferred manner of preventing such deformation or breakage, the several new and improved carrier strips 18 and 19 are respectively arranged as shown in FIG. 3 to also uniquely include a number of additional openings, as at 41 and 42, which are spatially distributed at uniform intervals along each carrier strip and interposed between adjacent ones of the charge-mounting holes as at 35. It will be appreciated by those skilled in the art that since it is commonly desired to position shaped charges at 3 inch intervals, the charge-mounting holes, as at 35, are preferably arranged at that spacing along the carrier strips 18 ad 19; and, therefore, the additional openings, as at 41 and 42, will be respectively disposed midway between adjacent mounting holes.

In the preferred embodiment of the new and improved strips 18 and 19, successful operations have been achieved with steels having a maximum elongation (i.e., elongation at the point of tensile failure) of between 10% and 15%, a breaking strength between 70 and 90-hectobars, and an impact strength of 3 to 7 - decajoules/cm$^2$. When a steel such as just described is employed, it has been found satisfactory and most convenient to simply arrange these additional openings, as at 41 and 42, to be circular holes of the same diameter as the threaded charge-mounting holes as at 35. Those skilled in the art will, of course, recognize how advantageous this will be in mass-producing carrier strips as at 18 and 19. There is, however, no need to thread these additional openings 41 and 42 since their sole function is to induce limited preferential bending of the carrier strips 18 and 19 along transverse axes (as at 43) respectively passing through each of these several additional openings. These deformation-inducing holes, as at 41 and 42, must, of course, be cooperatively sized in keeping with the type of steel used in the carrier strips 18 and 19, the particular dimensional sizes involved throughout a given design of the perforating apparatus 10, and the maximum deformation-inducing forces which can be developed by the charges 22.

Accordingly, as illustrated in FIG. 4, it has been found that when the new and improved perforating apparatus 10 of the present invention is operated in a gas-filled well bore, as at 11, the carrier strips 18 and 19 will be harmlessly deformed into a series of spatially-disposed bowed protrustions or successive, longitudinally-spaced arches, as at 44, of such a limited height that the expended strips can be readily retrieved through the small-diameter tubing string 15. As depicted, it will be recognized that the peaks of these successive arches, as at 44, are respectively centered about a charge-mounting hole, as at 35, and their terminations, as at 45 and 46, are generally centered along one of the axes 43 crossing the intermediately-located deformation-inducing holes, as at 41 and 42.

As previously mentioned, the several shaped charges 22 are uniquely manufactured so as to facilitate the turning of their containers 25 at least slightly in relation to their respective covers 24. This ability is, of course, contrary to the usual practice of tightly fitting the two halves of prior-art charge containers. Accordingly, once the charges 22 are respectively mounted along the carrier strips as at 18 and 19, this freedom of movement will allow these covers 24 to be first tightly fitted against the back side of the carrier strip and then allow the containers 25 to be respectively turned as required to successively align the several cord-receiving holes, as at 29, for rapid installation of the detonating cord 23.

Accordingly, it will be appreciated that the present invention has provided new and improved perforating apparatus especially adapted for operation in gas-filled well bores and including an elongated support member of a tough, ductile steel and having an arcuately-shaped transverse cross-section and carrying a plurality of encapsulated shaped charges which are tightly secured in a facing relationship against the convave rear surface of the support by means of axial projections on the noses of the charge capsules that are respectively threadedly engaged within threaded openings distributed longitudinally along the support member. To allow convenient and reliable installation of the detonating cord for the perforating apparatus, the charge capsules are uniquely arranged as two-part members which are cooperatively interfitted so as to allow at least limited turning of the rear portion of the capsule case in relation to its forward cover.

While only a particular embodiment of the present invention has been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. Perforating apparatus adapted for passage through well piping and including:

an elongated carrier strip with an arcuately-shaped transverse cross section of substantially-uniform thickness formed of a tough ductile steel and having a plurality of internally-threaded laterally-drected charge-mounting openings spatially disposed along the longitudinal axis of said carrier strip; and perforating means on said carrier strip and including a detonating cord, a plurality of encapsulated shaped explosive charges respectively enclosed in a two-part hollow case having a front case member carrying a threaded axial projection sized for cooperative engagement within said charge-mounting openings, a rear case member telescopically interfitted with said front case member and angularly positionable in relation thereto, means for cooperatively retaining said detonating cord on each of said hollow cases including a transverse cord-receiving opening arranged on each of said rear case members respectively and adapted for being aligned with one another upon rotation of said rear case members to a common angular orientation, and sealing means cooperatively arranged between each of said case members for fluidly sealing the interiors of said cases.

2. The perforating apparatus of claim 1 wherein said front case member is a generally-hemispherical domed cover having a rearward marginal portion, said rear case member is a hollow container having a forward marginal portion adapted for being telescopically interfitted with said rearward marginal portion, and said sealing means include a sealing member cooperatively engaged between adjacent opposing surfaces of said marginal portions.

3. The perforating apparatus of claim 2 wherein said forward marginal portion of said hollow container is telescopically disposed within said rearward marginal portion of said domed cover, and said rearward portion of said domed cover is frictionally engaged with an adjacent surface of said hollow container for tightly holding said case members together without unduly restricting limited rotation of said hollow container in relation to said domed cover.

4. An encapsulated shaped charge comprising:

a hollow charge case having interfitted members including a domed, fluid-impervious front cover having a rearward cylindrical marginal portion and a hollow, fluid-impervious rear container having a forward cylindrical marginal portion adapted for snug telescopic engagement with said rearward marginal portion of said front cover without unduly restricting at least limited rotational positioning of said interfitted case members;

explosive means in said hollow charge case;

sealing means cooperatively arranged between said marginal portions of said interfitted case members and adapted for fluidly sealing the interior of said hollow charge case;

means including a transversely-arranged opening defined exteriorly on the rear of said container and adapted for loosely retaining therein a detonating cord within detonating proximity of said explosive means; and means including a threaded axial projection extending forwardly from said front cover cooperatively arranged and adapted for tightly securing said hollow charge case to a support body without restricting rotational positioning of said rear container relative to said front cover for angularly orienting said transversely-oriented opening.

* * * * *